US011351088B2

(12) United States Patent
Cho et al.

(10) Patent No.: US 11,351,088 B2
(45) Date of Patent: Jun. 7, 2022

(54) DISPOSABLE CONTAINERS FOR CONTAINING PATIENT-CUSTOMIZED MEDICINAL FLUID, APPARATUS FOR MANUFACTURING THE SAME, AND METHOD FOR MANUFACTURING THE SAME

(71) Applicant: RMEDICA CO., LTD., Seoul (KR)

(72) Inventors: Seong Ryul Cho, Goyang-si (KR); Il Seob Shin, Seoul (KR); Koung Un Park, Seongnam-si (KR); Yun Ji Hong, Seongnam-si (KR)

(73) Assignee: RMEDICA CO., LTD., Seoul (KR)

( * ) Notice: Subject to any disclaimer, the term of this patent is extended or adjusted under 35 U.S.C. 154(b) by 232 days.

(21) Appl. No.: 16/774,336

(22) Filed: Jan. 28, 2020

(65) Prior Publication Data

US 2021/0007931 A1 Jan. 14, 2021

(30) Foreign Application Priority Data

Jul. 10, 2019 (KR) ..... 10-2019-0083034

(51) Int. Cl.

| | |
|---|---|
| ***A61J 1/14*** | (2006.01) |
| ***B65D 53/00*** | (2006.01) |
| ***B65D 65/38*** | (2006.01) |
| ***B65D 75/38*** | (2006.01) |

(52) U.S. Cl.

CPC ..... *A61J 1/1412* (2013.01); *B65D 53/00* (2013.01); *B65D 65/38* (2013.01); *B65D 75/38* (2013.01)

(58) Field of Classification Search

CPC ..... A61J 1/1412; B65D 53/00; B65D 65/38

USPC .... 222/215, 129, 94, 541.1, 541.6; 206/438, 206/541

See application file for complete search history.

(56) References Cited

U.S. PATENT DOCUMENTS 3,917,120 A * 11/1975 Larenz ..... B65D 75/48 206/820
3,924,745 A * 12/1975 Hannemann ..... B65D 75/322 222/541.9
4,502,616 A * 3/1985 Meierhoefer ..... A61J 1/067 206/820
4,871,091 A * 10/1989 Preziosi ..... A61F 9/0008 206/532

(Continued)

FOREIGN PATENT DOCUMENTS

JP S52-128790 A 10/1977
JP H05-330503 A 12/1993

(Continued)

*Primary Examiner* — Jacob K Ackun
(74) *Attorney, Agent, or Firm* — LRK Patent Law Firm

(57) ABSTRACT

A disposable container for containing a patient-customized medicinal fluid as a flowable material, which is adapted to dispense and seal the flowable material, the disposable container including: a plurality of container portions adapted to form spaces containing the flowable material; a bonding portion extended from tops of the container portions in such a manner as to come into contact with a surface of a film protecting the flowable material from the outside; and discharge portions extended from undersides of the container portions in such a manner as to be separable from the containing portions to discharge the flowable material to the outside, wherein the bonding portion connects the container portions with each other.

4 Claims, 8 Drawing Sheets

(56) References Cited

U.S. PATENT DOCUMENTS 4,921,137 A * 5/1990 Heijenga ..... B65D 75/5811 222/541.6
5,577,636 A * 11/1996 Fukuoka ..... B65D 35/44 222/541.9
6,557,731 B1 * 5/2003 Lyon ..... B65D 75/5811 222/107
7,004,322 B1 * 2/2006 Bartoli ..... B65D 75/5811 222/107
7,100,802 B2 * 9/2006 Sogaro ..... B65D 75/5811 401/133
7,540,389 B2 * 6/2009 Fontana ..... B65D 1/0238 215/47
D703,063 S * 4/2014 Garrity ..... B65D 75/00 D9/695
8,726,619 B2 * 5/2014 Bogle ..... A61J 1/1406 53/485
8,944,245 B2 * 2/2015 Erickson ..... A61M 5/3205 206/438
10,494,157 B2 * 12/2019 Chang ..... B65D 1/08
2010/0125097 A1 * 5/2010 Soil ..... A61K 47/14 206/570
2010/0212695 A1 * 8/2010 Gibis ..... A47L 15/4445 222/129
2015/0108023 A1 * 4/2015 Bergey ..... B29C 51/14 264/320
2015/0210456 A1 * 7/2015 Shi ..... B65D 1/095 222/541.6
2015/0314120 A1 * 11/2015 Gardner ..... A61M 5/315 206/438
2015/0368018 A1 * 12/2015 Broedsgaard ..... B65D 75/367 53/478
2016/0361231 A1 * 12/2016 Chou ..... A61J 1/16

FOREIGN PATENT DOCUMENTS

JP 2000-093512 A 4/2000
JP 2005-280830 A 10/2005
JP 2009-532279 A 9/2009
KR 10-2004-0016967 A 2/2004
KR 10-0583695 B1 10/2006
KR 10-2019-0013829 A 2/2019

* cited by examiner (a)

(b)

DISPOSABLE CONTAINERS FOR CONTAINING PATIENT-CUSTOMIZED MEDICINAL FLUID, APPARATUS FOR MANUFACTURING THE SAME, AND METHOD FOR MANUFACTURING THE SAME

CROSS REFERENCE TO RELATED APPLICATION

The present application claims the benefit of Korean Patent Application No. 10-2019-0083034 filed in the Korean Intellectual Property Office on Jul. 10, 2019, the entire content of which is incorporated herein by reference.

BACKGROUND OF THE INVENTION

1. Field of the Invention

The present invention relates to a disposable container for containing a patient-customized medicinal fluid, an apparatus for manufacturing the same, a method for manufacturing the same, a method for easily dispensing and storing a small quantity of patient-customized medicinal fluid, an apparatus for easily dispensing and storing a small quantity of patient-customized medicinal fluid, and a container for storing a small quantity of medicinal fluid provided by the apparatus.

2. Description of Related Art

Generally, a medicinal fluid prescribed to a patient through a physician is not a patient-customized medicinal fluid, but a medicinal fluid dispensed in given quantities into a standard container from a medicinal fluid produced in large quantities by a pharmaceutical company. However, the mass-produced medicinal fluid contained in the container is not customized to an individual patient, so that it is hard to be applicable to regenerative medicine utilizing a portion of a patient's body for his or her regenerative treatment. For example, a patient-customized substance like autologous serum eye drops which is manufactured with a patient's blood so as to be used only for himself or herself is not adequate to a large scaled environment for manufacturing medicinal fluids for a large number of patients. The present invention is suggested to overcome such limitations in the conventional practices. If a medicinal fluid is made and a container containing the medicinal fluid is conveniently made together a check-up for an individual patient in consideration of a health state, gene, and disease history of the individual patient, that is, if a patient-customized medicinal fluid container is easily manufactured, many advantages may be given to both of the patient who receives a prescription and the physician who provides the prescription.

So as to provide a prescription for a semisolid or liquid medicinal fluid for a patient, even in the conventional practices, many tries to dispense the semisolid or liquid medicinal fluid into containers through a separate dispensing tool like a spoon or a little bottle have been made, but it is difficult to dispense the medicinal fluid in accurate quantities only through the dispensing tool. If a large quantity of medicinal fluid has to be prescribed to the individual patient, further, it is very inconvenient to one by one dispense the medicinal fluid.

Furthermore, an apparatus for dispensing, sealing and cutting the medicinal fluid is disclosed in the conventional practices, but purchasing of the apparatus in a small-sized place like a pharmacy at which a small quantity of medicinal fluid for a specific patient is just made is inefficient economically, which causes non-use of the apparatus.

Accordingly, there is a need for development of a disposable container for easily dispensing and prescribing a small quantity of patient-customized medicinal substance/fluid and a method and apparatus for manufacturing the same.

SUMMARY OF THE INVENTION

Accordingly, the present invention has been made in view of the above-mentioned problems occurring in the related art, and it is an object of the present invention to provide a method for manufacturing a disposable container dispensing and prescribing a semisolid or liquid medicinal fluid in small quantities and an apparatus for manufacturing the disposable container.

It is another object of the present invention to provide a method and apparatus for manufacturing a disposable container having a plurality of spaces adapted to contain a semisolid or liquid medicinal fluid in small quantities in such a manner as to be spaced apart from each other at given intervals, so that it is easy to seal and cut the respective spaces after the medicinal fluid is contained in the spaces of the disposable container.

It is yet another object of the present invention to provide a disposable container that is provided with a film made of a safe material for preventing damage even in a high/low temperature environment when the film is sealedly covered thereon.

To accomplish the above-mentioned objects, according to one aspect of the present invention, there is provided a disposable container for containing a patient-customized medicinal fluid as a flowable material, which is adapted to dispense and seal the flowable material, the disposable container including: a plurality of container portions adapted to form spaces containing the flowable material; a bonding portion extended from tops of the container portions in such a manner as to come into contact with a surface of a film protecting the flowable material from the outside; and discharge portions extended from undersides of the container portions in such a manner as to be separable from the containing portions to discharge the flowable material to the outside, wherein the bonding portion connects the container portions with each other.

According to the present invention, desirably, the bonding portion has cut lines formed between the neighboring container portions in such a manner as to be separable by a user.

According to the present invention, desirably, the bonding portion is disposed vertically with respect to the container portions and has a given width from edges of the spaces containing the flowable material, the given width for contact with the surface of the film being in the range of 1 to 10 mm.

According to the present invention, desirably, a distance between centers of the neighboring container portions is in the range of 9 to 14 mm.

To accomplish the above-mentioned objects, according to another aspect of the present invention, there is provided a sealing apparatus for dispensing a flowable material into at least one or more disposable containers and sealing the disposable containers, the sealing apparatus including: an upper casing; and a lower casing, wherein the upper casing has a heating plate located on one surface coming into contact with the lower casing to apply heat to a film for sealing the disposable containers, the lower casing has a cartridge for seating the disposable containers and fixing the positions of the disposable containers and a frame for inserting the cartridge on which the disposable containers are seated and protecting the cartridge while the heat is being applied from the heating plate, and the disposable containers each having a plurality of spaces containing the flowable material arranged side by side are seated on the cartridge in parallel with each other.

According to the present invention, desirably, the heating plate whose one surface coming into contact with the lower casing is embossed so as to prevent air between the film and the disposable containers from being produced.

According to the present invention, desirably, the frame has holes adapted to insert the disposable containers, and an area of each hole is the same as a sectional area of each space containing the flowable material.

To accomplish the above-mentioned objects, according to yet another aspect of the present invention, there is provided a method for manufacturing a disposable container for dispensing and sealing a flowable material, the method including the steps of: dispensing the flowable material into the disposable container having spaces open on tops thereof to contain the flowable material; seating the disposable container into which the flowable material is dispensed onto a sealing apparatus and covering a film on top of the disposable container to a length corresponding to a length of the seated disposable container; and applying heat to the film to seal the spaces containing the flowable material.

According to the present invention, desirably, the disposable container has the spaces arranged side by side, and a distance between the centers of the neighboring spaces is in the range of 9 to 14 mm.

According to the present invention, desirably, the method further includes, after sealing the spaces containing the flowable material, the step of individually separating the spaces into which the flowable material is dispensed from each other by means of cut lines formed on top of the disposable container.

BRIEF DESCRIPTION OF THE DRAWINGS

The above and other objects, features and advantages of the present invention will be apparent from the following detailed description of the embodiments of the invention in conjunction with the accompanying drawings, in which.

DETAILED DESCRIPTION OF THE EMBODIMENTS

Figure 1:
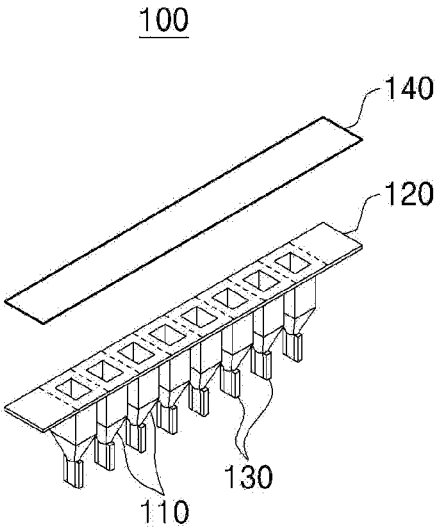
FIG. 1 is a perspective view showing a disposable container for containing a patient-customized medicinal fluid according to the present invention.

Hereinafter, the present invention is disclosed with reference to the attached drawings. Objects, characteristics and advantages of the present invention will be more clearly understood from the detailed description as will be described below and the attached drawings. In the description, it should be noted that the parts corresponding to those of the drawings are indicated by corresponding reference numerals.

All terms used herein, including technical or scientific terms, unless otherwise defined, have the same meanings which are typically understood by those having ordinary skill in the art. The terms, such as ones defined in common dictionaries, should be interpreted as having the same meanings as terms in the context of pertinent technology, and should not be interpreted as having ideal or excessively formal meanings unless clearly defined in the specification. Terms used in this application are used to only describe specific exemplary embodiments and are not intended to restrict the present invention. An expression referencing a singular value additionally refers to a corresponding expression of the plural number, unless explicitly limited otherwise by the context.

In this application, terms, such as "comprise", "include", or 'have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

Hereinafter, the present invention will be in detail explained with reference to the attached drawings.

FIG. 1 is a perspective view showing a disposable container 100 for containing a patient-customized medicinal fluid (hereinafter, referred to as "disposable container") according to the present invention.

The disposable container 100 according to the present invention contains both of a liquid medicinal fluid and a semisolid material having given viscosity, that is, contains a flowable material. For example, the disposable container 100 according to the present invention may contain medical products like a liquid medicinal fluid and an ointment having viscosity applicable by a finger, hair cosmetic products like oxidizers and dyeing agents, skin cosmetic products like moisture cream, eye cream, and so on.

For the convenience of the description, hereinafter, a material contained in the disposable container 100 according to the present invention is called a flowable material.

As shown in FIG. 1, the disposable container 100 according to the present invention, which is a container adapted to dispense and seal a flowable material, includes container portions 110 for containing the flowable material, a bonding portion 120 extended from tops of the container portions 110, and discharge portions 130 extended from the undersides of the container portions 110.

The container portions 110 serve to form spaces in which the flowable material is contained. In detail, each container portion 110 is a concavely open on top thereof and is taperedly closed on underside thereof to discharge the flowable material in small quantities. Without being limited thereto, however, the container portions 110 may have various shapes according to capacities and discharge quantities of the flowable material.

Further, the container portions 110 are made of various kinds of synthetic resins or materials (for example, low density polyethylene (LDPE)) safe in a high or low temperature environment, without any breakage. In addition thereto, the container portions 110 are made of transparent synthetic resins so that an amount of the flowable material contained therein can be checked with the naked eye and also have given elasticity so that they can be pressurized by a user.

Further, the container portions 110 into which the flowable material is dispensed in small quantities can be formed integrally with each other by means of the bonding portion 120.

The bonding portion 120 is extended from tops of the container portions 110 to connect the neighboring container portions 110 to each other. Further, the bonding portion 120 comes into contact with a surface of a film 140 for protecting the flowable material from the outside. When viewed from top of the disposable container 100, in detail, the bonding portion 120 has given widths along edges of spaces containing the flowable material on the open tops of the container portions 110 and is extended in a vertical direction to the container portions 110. The bonding portion 120 comes into contact with the surface of the film 140 along the edges of the container portions 110.

Figure 2:
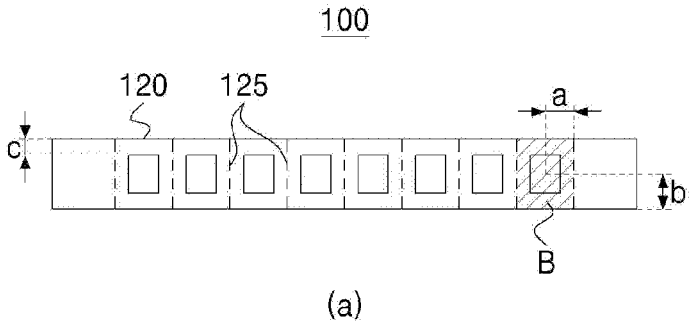
FIG. 2 is top views showing the disposable container for containing a patient-customized medicinal fluid according to the present invention.
Figure 2:
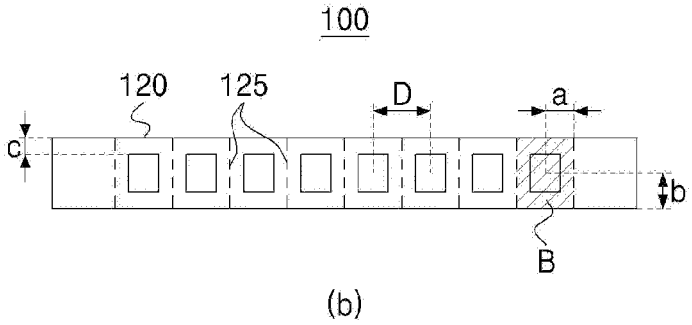

FIG. 2 is top views showing the disposable container for containing a patient-customized medicinal fluid according to the present invention.

Referring to (a) of FIG. 2, the bonding portion 120 is formed along the edges of the container portions 110 on tops of the container portions 110, and the surface of the film 140 comes into contact with the bonding portion 120 to seal internal spaces of the container portions 110. In this case, the bonding portion 120 desirably has a given width so that it can come into contact with the film 140, and a given width c formed along the edges of the container portions 110 is in the range of 1 to 10 mm. If the given width c of the bonding portion 120 is less than 1 mm, an area of the bonding portion 120 contacted with the film 140 is small, so that in a process where the container portions 110 are separated one by one or in a process where the disposable container 100 is kept in a high/low temperature environment, the film 140 may peel off. If the width c of the bonding portion 120 is greater than 10 mm, it is substantially longer than sectional areas of the container portions 110 containing the flowable material, so that a manufacturing efficiency of the disposable container 100 may be deteriorated badly. Accordingly, the width c of the bonding portion 120 is in the range of desirably 1 to 10 mm, more desirably 1.5 to 5 mm.

Further, the bonding portion 120 connecting the plurality of container portions 110 has cut lines 125 formed between the neighboring container portions 110 in such a manner as to be separable by the user. In detail, the cut lines 125 are formed on left and right sides of the bonding portion 120 with respect to one container portion 110.

The width c of the bonding portion 120 sealing the internal spaces of the container portions 110 is determined under the assumption that each container portion 110 has a horizontal size of 3 mm and a vertical size of 3 to 4 mm, and the capacity and size of the container portion 110 containing the flowable material may be varied according to the user's design. The desirable width c of the bonding portion 120 is 20 to 45% of a horizontal or vertical length 'a' and 'b' of a sealed surface B formed on each container portion 110 through the bonding between the bonding portion 120 and the film 140. If the width c of the bonding portion 120 is greater than 20%, the flowable material can be contained safely in the disposable container 100, without any leakage, and also, the volume of the disposable container 100 can be minimized. If the width c of the bonding portion 120 is less than 45%, the film 140 can be prevented from peeling off due to the weight of the flowable material or the invasion of the flowable material to a space between the bonding portion 120 and the film 140.

Referring to (b) of FIG. 2, a distance D between the centers of the neighboring container portions 110 is in the range of desirably 5 to 20 mm, more desirably 9 to 14 mm in such a manner as to correspond to a distance formed on an adapter 300 for dispensing the flowable material in small quantities, thereby ensuring a bonded area with the film 140. As the distance D increases, the area of the bonding portion 120 becomes enlarged. If the distance D is excessively long, however, the disposable container 100 may not have any good portability, and therefore, the distance D between the centers of the neighboring container portions 110 is desirably in the range of 5 to 20 mm. Further, the distance D is more desirably in the range of 9 to 14 mm, and in this case, a given area of the bonding portion 120 is ensured to allow the film 140 to be stably attached to the bonding portion 120, without peeling off therefrom. Furthermore, the distance D is determined in consideration of a distance between channels of a dispensing pipette (having multi-channels) as a standard type pipette commercialized on the market.

Referring back to FIG. 1, the present invention will be explained.

The discharge portions 130 serve to discharge the dispensed flowable materials contained in the container portions 110 to the outside. Each discharge portion 130 is extended from the underside of the corresponding container portion 110 and is open on the end connected to the container portion 110. In detail, a given hole (not shown) is formed at a position where the container portion 110 and the discharge portion 130 are connected with each other, and at the position, the container portion 110 and the discharge portion 130 can be separated from each other by means of the user.

The film 140 serves as a cover coming into contact with the surface of the boding portion 120 to safely protect the flowable material from the outside, and in this case, the film 140 can be attached to the bonding portion 120 by means of thermal bonding. Moreover, cut lines 145 (See FIG. 4) easily separable by the user are formed on the film 140, and the cut lines 145 match with the cut lines 125 to provide one sealed disposable container 100.

In the same manner as the container portions 110, also, the film 140 is made of various synthetic resins having no damage even in an external environment, and as the film 140 is attached to the bonding portion 120 by means of the thermal bonding, it can have first to third layers. For example, the first layer coming into contact with the bonding portion 120 is made of LDPE which is the same as the container portions 110 and the bonding portion 120, the second layer is made of rigid aluminum or nylon capable of supporting the weights of the flowable materials contained in the container portions 110, and the third layer is made of PE strong in heat for the thermal bonding. However, the materials of the film 140 may be different according to a method for bonding the film 140 to the bonding portion 120, without being limited thereto.

Moreover, the flowable materials dispensed in small quantities into the container portions 110 of the disposable container 100 may be a substance like a medicinal fluid injected into a human body or coming into contact with the human body, and accordingly, the containing portions 110, the bonding portion 120, the discharge portions 130, and the film 140 are made of materials capable of being sterilized.

Up to now, the disposable container 100 according to the present invention has been explained. According to the present invention, the disposable container 100 can dispense various flowable materials like liquid medicinal fluid, ointment, and so on into the container portions 110 and seal the dispensed flowable materials. Accordingly, a patient-customized medicinal fluid can be made and dispensed in small quantities so as to allow the dispensed medicinal fluids to be administered to a patient several times, and as the medicinal fluid can be safely sealed, further, the disposable container 100 can be easily applied to a manufacturing field like a pharmacy and a cosmetic product manufacturing field.

Hereinafter, an explanation on a disposable container sealing apparatus 200 capable of dispensing the flowable material into the container portions 110 of the disposable container 100 according to the present invention will be given.

Figure 3:
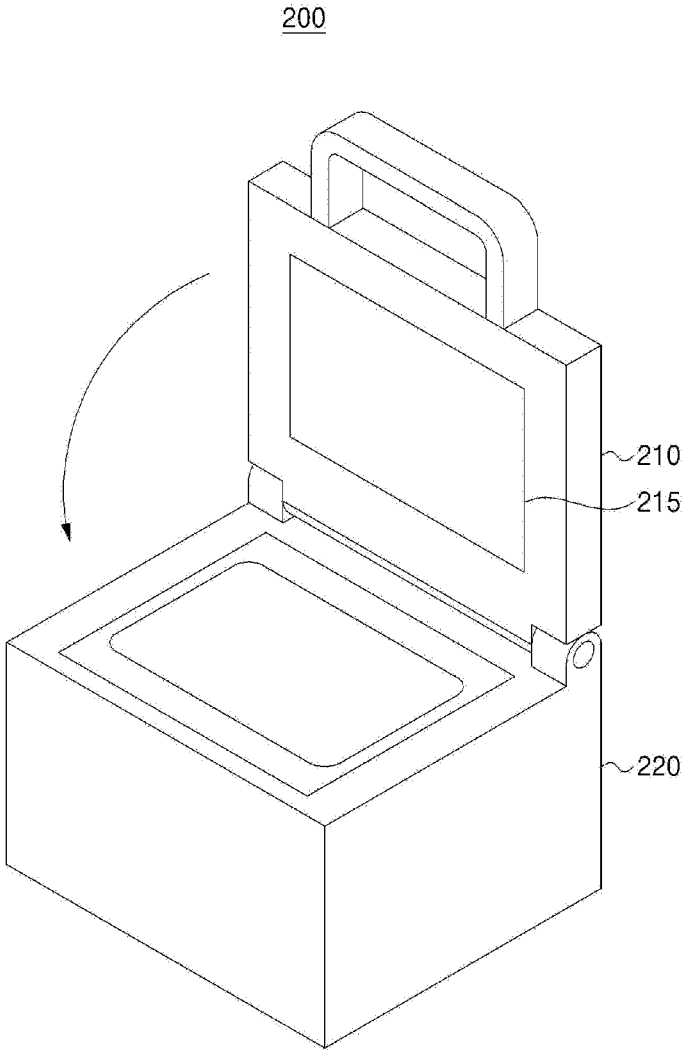
FIG. 3 is a perspective view showing a sealing apparatus for the disposable container according to the present invention.
Figure 4:
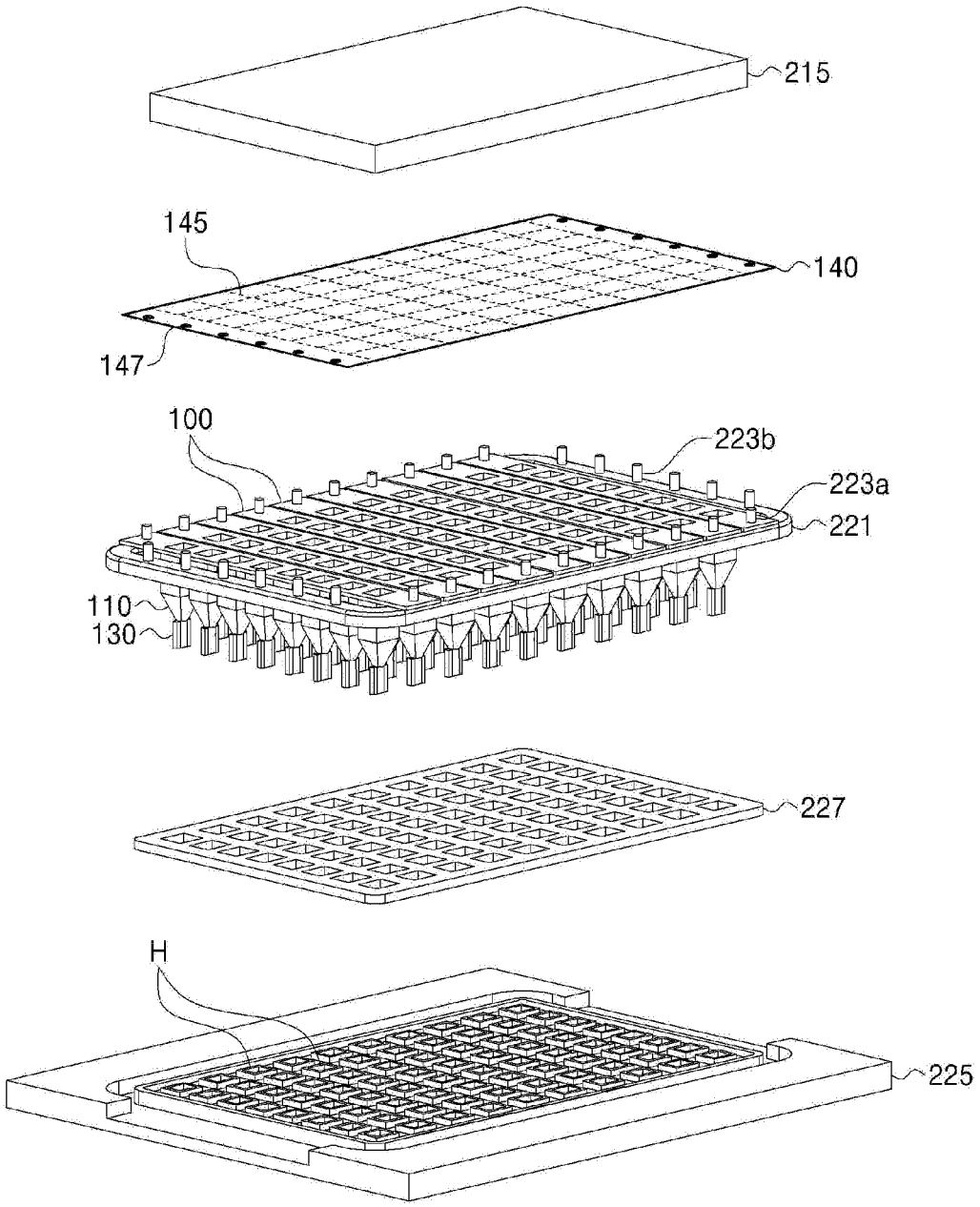
FIG. 4 is an exploded perspective view showing parts of the sealing apparatus for sealing the disposable container according to the present invention.

FIG. 3 is a perspective view showing a disposable container sealing apparatus (hereinafter, referred to as "container sealing apparatus") according to the present invention, and FIG. 4 is an exploded perspective view showing parts of the container sealing apparatus according to the present invention.

As shown in FIG. 3, the container sealing apparatus 200 largely includes an upper casing 210 and a lower casing 220. The lower casing 220 is configured to allow the disposable container 100 to be seated onto the internal space thereof, and the upper casing 210 to allow a heating plate 215 to be located thereon to seal the disposable container 100. In this case, the disposable container 100 is a container having a plurality of spaces (the container portions 110) containing the flowable material, and one disposable container 100 is extended long in one direction.

Further, the lower casing 220 has a space for seating the film 140 and a groove for discharging the film 140, which are formed at the inside thereof, and a cutting part (not shown) is disposed on one side where the upper casing 210 is rotated with respect to the lower casing 220 to cut off the film 140 discharged from the groove. Of course, the film 140 may be disposed at other positions, not in the lower casing 220.

As shown in FIG. 4, the container sealing apparatus 200 has the heating plate 215 adapted to apply heat to the front surface of the film 140 and a cartridge 221 and a frame 225 for seating the disposable container 100. The cartridge 221 has protruding members 223*a* and 223*b* arranged along the four edges thereof to fix both ends of the disposable container 100 or the film 140. Accordingly, the disposable containers 100 extended long in one direction can be arranged in parallel with each other on the cartridge 221 through the protruding members 223*a* protruding from the facing edges of the cartridge 221, and after the disposable containers 100 are seated onto the cartridge 221, next, the film 140 for sealing the disposable containers 100 is seated onto the cartridge 221 through the protruding members 223*b* protruding from the remaining facing edges of the cartridge 221. In detail, a plurality of holes 147 is formed on both side edges of the film 140, and the protruding members 223*b* are fitted to the holes 147 of the film 140, so that the film 140 can be seated onto the cartridge 221.

The cartridge 221 on which the disposable containers 100 are seated is insertedly located in the frame 225, and since heat is applied to the lower casing 220 on which the film 140 is located through the heating plate 215, a heat radiating frame 227 is seated onto top of the frame 225 to protect the cartridge 221 and the disposable containers 100 from the heat.

In more detail, the frame 225 has holes H protruding therefrom to insert the container portions 110 so that the heat radiating frame 227 can be fittedly coupled to the insertion holes H. Further, an area of each hole H is the same as a vertical sectional area of each container portion 110 containing the flowable material.

Also, the heat radiating frame 227 is made of a material providing a heat radiating effect, and in a process where the disposable containers 100 are sealed by the film 140 through the application of the heat, one surface of the disposable containers 100 seated onto the frame 225 is prevented from being damaged. Further, the heat radiating frame 227 is made of an elastic material like silicone, and when compared with an example where only the frame 225 made of a metal material is located, the disposable containers 100 can be more rigidly attached to the film 140 through the heat radiating frame 227 made of the elastic material.

Furthermore, the heating plate 215 whose one surface coming into contact with the lower casing 220 is embossed, and in the process where the film 140 is attached to the disposable containers 100 by means of thermal bonding, accordingly, the heating plate 215 can prevent air between the film 140 and the disposable containers 100 from being produced.

Figure 5A:
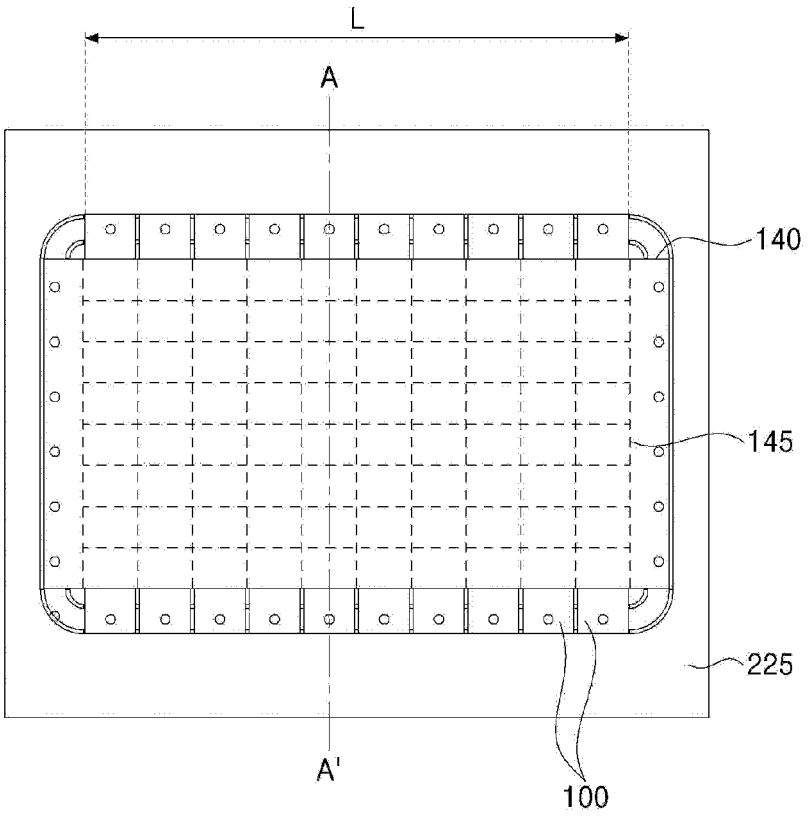
FIGS. 5A to 5C are top and side views showing the disposable container seated onto a cartridge and a frame of the sealing apparatus according to the present invention.
Figure 5B:
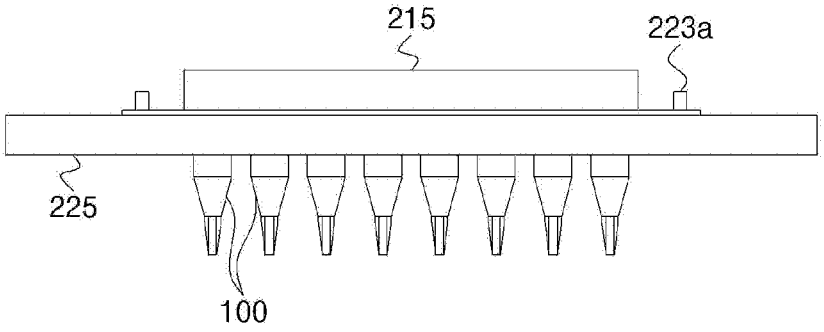
Figure 5C:
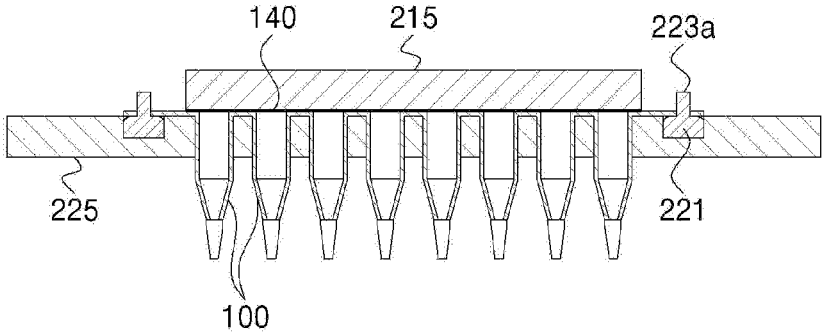

FIGS. 5A to 5C are top and side views showing the disposable containers 100 seated onto the cartridge 221 and the frame 225 according to the present invention. As shown in FIG. 5A, the film 140 is disposed on tops of the disposable containers 100 seated onto the cartridge 221 and the frame 225, and a length L of the film 140 can be varied according to the number of disposable containers 100.

When the disposable containers 100 as shown in FIG. 5A are viewed on one side, further, it can be checked that the disposable containers 100 are seated onto the cartridge 221 and the frame 225 in such a manner as to correspond to a width of the heating plate 215, as shown in FIG. 5B, and when the disposable container 100 is cut off along the line A-A' of FIG. 5A, it can be checked that the film 140 and the disposable containers 100 come into close contact with each other through the heating plate 215, as shown in FIG. 5C.

Up to now, the container sealing apparatus 200 according to the present invention has been explained. According to the present invention, the container sealing apparatus 200 is configured to allow the flowable material to be dispensed into the disposable containers 100 and to allow the disposable containers 100 to be completely sealed to prevent the contact with air, thereby preventing chemical/physical damages of the flowable material like the oxidization of the flowable material.

Further, the container sealing apparatus 200 can be compacterized so that the disposable container for containing a semisolid or liquid flowable material in a user's desired quantities can be manufactured, thereby improving a manufacturing efficiency.

Hereinafter, an explanation on a method for manufacturing the disposable container 100 for dispensing and sealing the flowable material through the container sealing apparatus 200 according to the present invention will be given.

Figure 6:
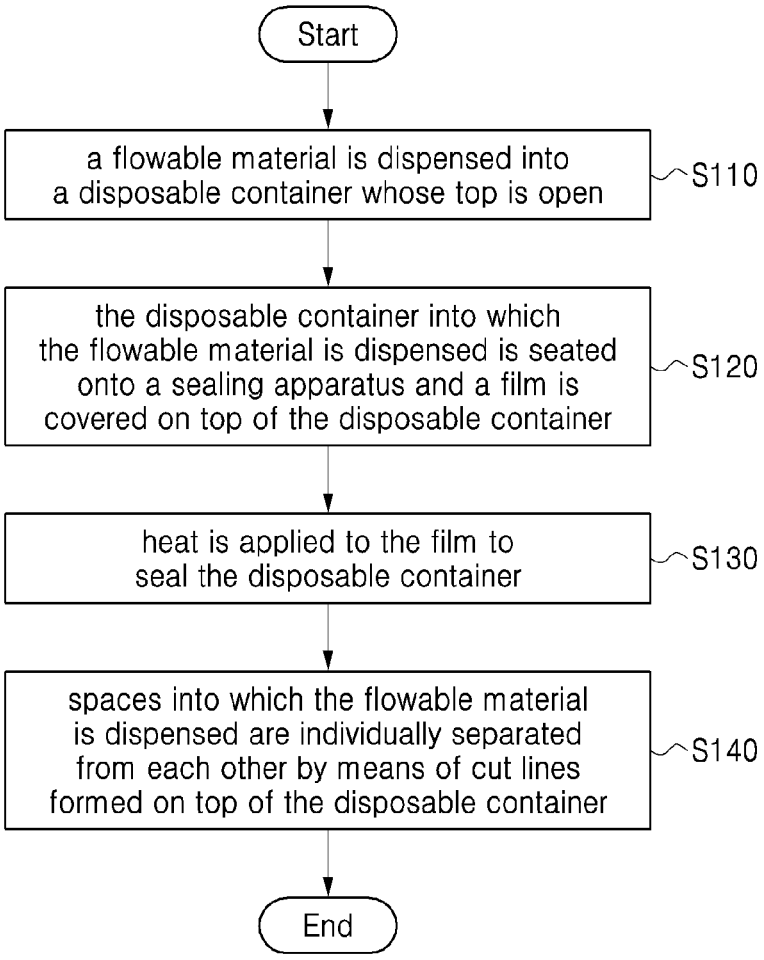
FIG. 6 is a flowchart showing a method for manufacturing the disposable container according to the present invention.
Figure 7:
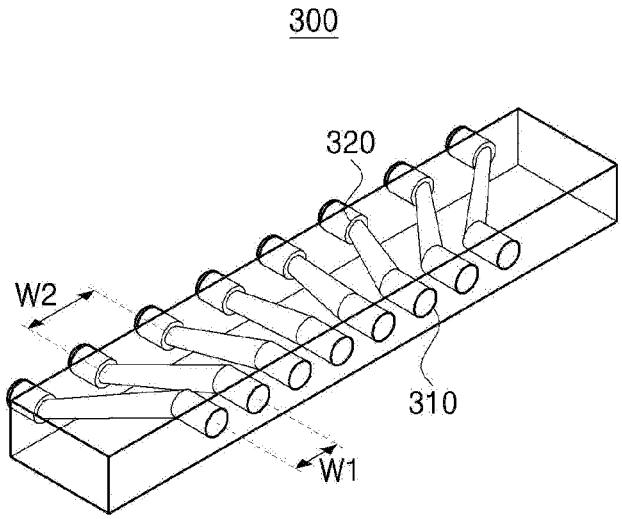
FIG. 7 is a perspective view showing an adapter for dispensing the flowable material into the disposable container according to the present invention.

FIG. 6 is a flowchart showing a method for manufacturing the disposable container according to the present invention, and FIG. 7 is a perspective view showing an adapter for dispensing the flowable material into the disposable container according to the present invention.

The method for manufacturing the disposable container according to the present invention is a just desirable example in accomplishing the objects of the present invention, and if necessary, some of steps may be added or deleted. Of course, any one step may be included in another step.

First, a flowable material is dispensed into a disposable container 100 whose top is open (Step S110). In this case, the disposable container 100 has a plurality of spaces arranged side by side in such a manner as to contain the dispensed flowable material, and a scale mark is formed on the outer surface of the disposable container 100 to check a quantity of the flowable material contained in the disposable container 100 with the naked eye of the user.

Meanwhile, a pipette (not shown) having multi-channels capable of dispensing a flowable material generally has a distance of 9 to 14 mm between inlets from which the flowable material is discharged. In detail, the distance between the multi-channels of the pipette is in the same range as above. According to the present invention, an adapter 300 is used to connect the distance of the pipette with the distance of the disposable container 100, and the adapter 300 has a shape as shown in FIG. 7.

Referring to FIG. 7, a distance W1 between neighboring inlets 310 formed on one end of the adapter 300 is 9 mm, which is the same as the distance of the pipette, and a distance W2 between neighboring outlets 320 formed on the other end of the adapter 300 is 5 to 20 mm, which corresponds to the distance D between the centers of the neighboring spaces of the disposable container 100.

Moreover, the distance D between the centers of the neighboring spaces containing the flowable materials on the disposable container 100 is in the range of 9 to 14 mm, and accordingly, the flowable material is dispensed by the adapter 300 and sealed, thereby ensuring a good sealing force.

After the step S110, the disposable container 100 into which the flowable material is dispensed is seated onto the container sealing apparatus 200, and the film 140 is covered on top of the disposable container 100 seated onto the container sealing apparatus 200 to a length corresponding to a length of the seated disposable container 100 (Step S120). In detail, the object of the present invention is to provide the method for manufacturing a small number of disposable containers 100 customized for a specific patient, and accordingly, at least one disposable container 100 can be seated onto the container sealing apparatus 200. The film 140 with the length corresponding to the length of the seated disposable container 100 is covered on top of the disposable container 100, and the film 140 may be provided separately from the container sealing apparatus 200 or drawn therefrom.

After the step S120, heat is applied to the film 140 to seal the disposable container 100 (Step S130). In detail, the heating plate 215 disposed on top of the container sealing apparatus 200 is operated to press the disposable container 100 downward so that the disposable container 100 can be sealed with the film 140. At this time, the contact area of the disposable container 100, which comes into contact with the surface of the film 140, is adjusted, so that the film 140 can stably seal the disposable container 100, without peeling off.

The function and width of the bonding portion 120 of the disposable container 100 has been explained in the above, and therefore, they will be not explained anymore for the brevity of the description.

After the step S130, the container portions having the dispensed flowable materials in the disposable container 100 are individually separated from each other by means of the cut lines 125 formed on tops thereof (Step S140). In this case, the cut lines 125 are formed on left and right sides of the bonding portion 120 with respect to one container portion having one dispensed flowable material, and after one of the container portions of the disposable container 100 110 is separated from the neighboring container portion, the discharge portion 130 formed on the opposite side to the sealed top side of the container portion is cut off to apply the flowable material to a given position.

Up to now, the method for manufacturing the disposable container 100 according to the present invention has been explained. According to the present invention, the semisolid or liquid flowable material is dispensed in small quantities and sealed with the film, thereby safely keeping the substance, and further, the flowable material is discharged through the discharge portion formed on the opposite side to the sealed area, so that through the method, the disposable container 100 can be easily manufactured.

Although embodiments of the present invention have been described with reference to the attached drawings, those skilled in the art may understand that the present invention can be embodied in other specific forms without changing the technical spirit or essential features thereof. Therefore, it should be understood that the embodiments described above are illustrative, not restrictive, in all aspects.

As described above, the disposable container according to the present invention can dispense and seal the semisolid or liquid medicinal fluid in small quantities, thereby safely storing the medicinal fluid, and can easily discharge the medicinal fluid through the discharge portion formed on the opposite side to the sealed area thereof.

In addition, the disposable container according to the present invention can be provided with the container portions and the film made of a material resistant to high/low temperature environment and impact, thereby safely storing the medicinal fluid contained therein.

Also, the disposable container of the present invention can be made by a user's desired number because an apparatus for sealing the disposable container containing the semisolid or liquid medicinal fluid is compacterized, thereby improving a manufacturing efficiency.

The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

What is claimed is:

1. A disposable container for containing a patient-customized medicinal fluid as a flowable material, which is adapted to dispense and seal the flowable material, the disposable container comprising:

a plurality of container portions adapted to form spaces containing the flowable material;

a bonding portion extended from tops of the container portions in such a manner as to come into contact with a surface of a film protecting the flowable material from the outside; and discharge portions extended from undersides of the container portions in such a manner as to be separable from the containing portions to discharge the flowable material to the outside, wherein the bonding portion connects the container portions with each other.

2. The disposable container according to claim 1, wherein the bonding portion has cut lines formed between the neighboring container portions in such a manner as to be separable by a user.

3. The disposable container according to claim 1, wherein the bonding portion is disposed vertically with respect to the container portions and has a given width from edges of the spaces containing the flowable material, the given width for contact with the surface of the film being in the range of 1 to 10 mm.

4. The disposable container according to claim 1, wherein a distance between centers of the neighboring container portions is in the range of 9 to 14 mm.

* * * * *